US005209290A

United States Patent [19]

Chigira

[11] Patent Number: 5,209,290

[45] Date of Patent: May 11, 1993

[54] HEAT EXCHANGER

[75] Inventor: Hitoshi Chigira, Maebashi, Japan

[73] Assignee: Sanden Corporation, Gunma, Japan

[21] Appl. No.: 878,386

[22] Filed: May 5, 1992

[30] Foreign Application Priority Data

May 10, 1991 [JP] Japan ..... 3-32614[U]

[51] Int. Cl.[5] ..... F28F 9/00

[52] U.S. Cl. ..... 165/149; 165/178; 165/906

[58] Field of Search ..... 165/149, 178, 906

[56] References Cited

U.S. PATENT DOCUMENTS

| | | | |
|---|---|---|---|
| 840,295 | 1/1907 | Bryant | 165/149 |
| 2,294,030 | 8/1942 | Higham et al. | 165/149 |
| 2,365,497 | 12/1944 | Smith | 165/149 X |
| 2,792,201 | 5/1957 | Whistler, Jr. | 165/149 |
| 4,479,668 | 10/1984 | Jacquet | 285/137 R |
| 4,569,390 | 2/1986 | Knowlton et al. | 165/149 |
| 5,069,275 | 12/1991 | Suzuki et al. | 165/67 |

FOREIGN PATENT DOCUMENTS

| | | | |
|---|---|---|---|
| 59-210300 | 11/1984 | Japan | 165/178 |
| 499641 | 7/1938 | United Kingdom | 165/149 |

*Primary Examiner*—Allen J. Flanigan
*Attorney, Agent, or Firm*—Baker & Botts

[57] ABSTRACT

A heat exchanger body is connected in fluid communication with external tubing via tube fittings. The tube fittings are supported by a supporting member that is brazed to the heat exchanger body. The supporting member can securely support the tube fitting. The supporting member can be brazed together with the heat exchanger body, thus making assembly and fabrication of the heat exchanger easier.

15 Claims, 8 Drawing Sheets

HEAT EXCHANGER

BACKGROUND OF THE INVENTION

1. Field of the Invention

The present invention relates to heat exchangers for use as condensers, and more particularly to a structure for supporting inlet and outlet tube fittings.

2. Description of the Prior Art

FIGS. 1 and 2 show conventional heat exchangers. FIG. 1 shows a multi-flow type heat exchanger. In this heat exchanger, a plurality of flat heat-transfer tubes 2 are disposed at predetermined intervals between a pair of header pipes 1A and 1B extending in parallel relation to each other. Corrugated fin units 3 are provided at each position between heat-transfer tubes 2. Corrugated fin units 3 are brazed to heat-transfer tubes 2. Header pipes 1A and 1B, flat heat-transfer tubes 2 and corrugated fin units 3 constitute a heat exchanger body.

Inlet 4A is connected for fluid communication with header pipe 1A for introduction of a heat exchange medium (for example, a refrigerant) into header pipe 1A. Outlet 4B is connected for fluid communication with header pipe 1B for discharging the heat exchange medium from header pipe 1B. Inlet 4A and outlet 4B are connected in fluid communication with external tubes 6 by tube fittings 5. Attachment members 7A and 7B for attaching the heat exchanger to an external member (not shown) are provided on the sides of header pipes 1A and 1B, respectively. Attachment members 7A and 7B are constructed from channels. Attachment members 7A and 7B hold header pipes 1A and 1B along the sides thereof, and are fixed to the header pipes by rivets 8. The heat exchanger is fixed to, for example, a frame of a vehicle (not shown) by fixing attachment members 7A and 7B to the frame via appropriate fasteners.

Union supporting members 9 are attached to attachment members 7A and 7B. Union supporting members 9 hold and support tube fittings 5 on the inlet and outlet sides.

FIG. 2 shows a serpentine type heat exchanger. In this heat exchanger, straight portions 10A of serpentine flat tube 10 are disposed at predetermined intervals in parallel relation to each other. Corrugated fin units 11 are provided at each position between the parallel straight portions 10A and brazed in position. Serpentine flat tube 10 and corrugated fin units 11 constitute a heat exchanger body.

Inlet 12A is in fluid communication with one end of serpentine flat tube 10 for introducing a heat exchange medium into tube 10. Outlet 12B is in fluid communication with the other end of tube 10 for discharging the heat exchange medium from tube 10. Inlet 12A and outlet 12B are connected in fluid communication with external tubes 14 by tube fittings 13. Attachment members 15A and 15B for attaching the heat exchanger to an external member (not shown) are provided on the sides of serpentine flat tube 10. Attachment members 15A and 15B are also constructed from channels. Attachment members 15A and 15B have hexagonally shaped holes 16 which mate with the hexagonal outer shape of tube fittings 13. Attachment members 15A and 15B hold the heat exchanger body on both sides and are fixed to the heat exchanger body by rivets 17. This heat exchanger is attached to, for example, a frame of a vehicle in a manner similar to that of the heat exchanger of FIG. 1.

Since union supporting members 9 are fixed to attachment members 7A and 7B attached to the heat exchanger body in the heat exchanger shown in FIG. 1, and since tube fittings 13 are supported by similar attachment members 15A and 15B in the heat exchanger shown in FIG. 2, the tube fittings must be attached at these predetermined locations. However, in the case where the heat exchanger is placed in a vehicle, there are various structural variations which depend on the vehicle and engine compartment design. In some instances, the supporting members and tube fittings cannot be attached in the above described manners. In such cases, other means for attaching the supporting members are required. Thus, the overall cost is increased and assembly and fabrication are complicated. Moreover, in the heat exchanger shown in FIG. 1, union supporting members 9 must be fixed to attachment members 7A and 7B by screws or spot welding. This also increases costs. Furthermore, in the heat exchanger shown in FIG. 2, attachment members 15A and 15B are relatively large channel members which are expensive and heavy.

SUMMARY OF THE INVENTION

Accordingly, an object of the present invention is to provide a heat exchanger which can facilitate the assembly and the attachment of a supporting member for the tube fitting.

To achieve this object, a heat exchanger according to the present invention is herein provided. The heat exchanger comprises a heat exchanger body having a plurality of substantially parallel heat-transfer tubes. The heat exchanger body is connected in fluid communication with an external tube via a tube fitting. The tube fitting is supported by a supporting member brazed to the heat exchanger body.

In a heat exchanger according to the present invention, the supporting member has a structure for appropriately supporting the tube fitting. The supporting member is brazed to the heat exchanger body so that the tube fitting is supported by the supporting member. Thus, the tube fitting is fixed to the heat exchanger body by the brazed supporting member. A large member such as a channel is not necessary. Therefore, the attachment structure is simplified. In addition, since the brazing of the supporting member and heat exchanger body ca be conducted simultaneously, the fabrication of the entire heat exchanger is simplified.

Some preferred exemplary embodiments of the invention will now be described with reference to the accompanying drawings, which are given by way of example only, and are not intended to limit the present invention.

DETAILED DESCRIPTION OF THE PREFERRED EMBODIMENTS OF THE INVENTION

Figure 1:
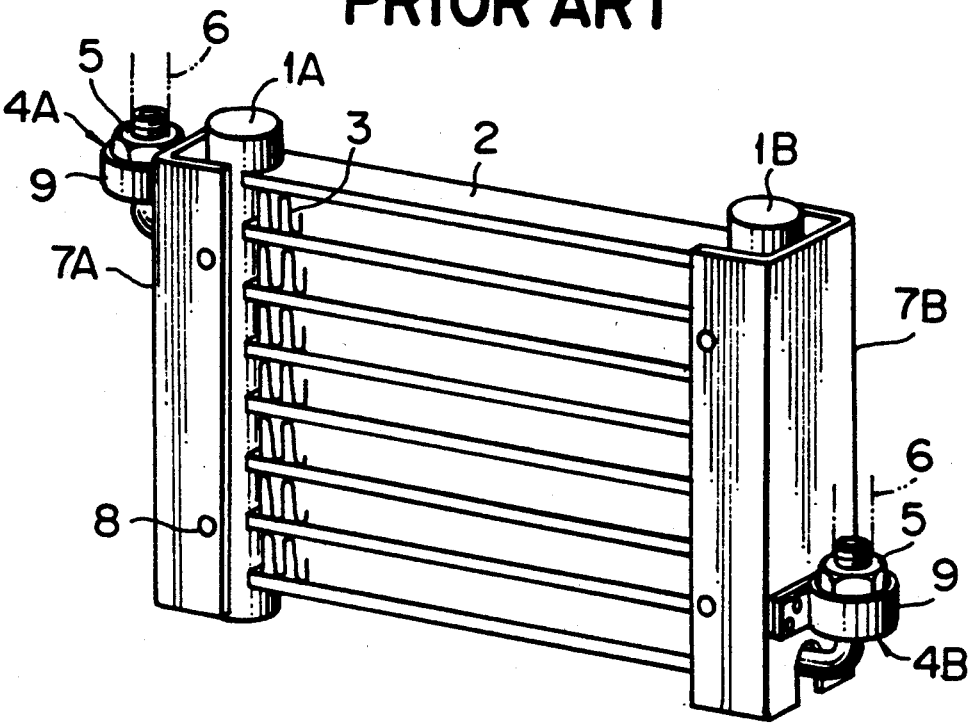
FIG. 1 PRIOR ART
FIG. 1 is a perspective view of a conventional heat exchanger.
Figure 2:
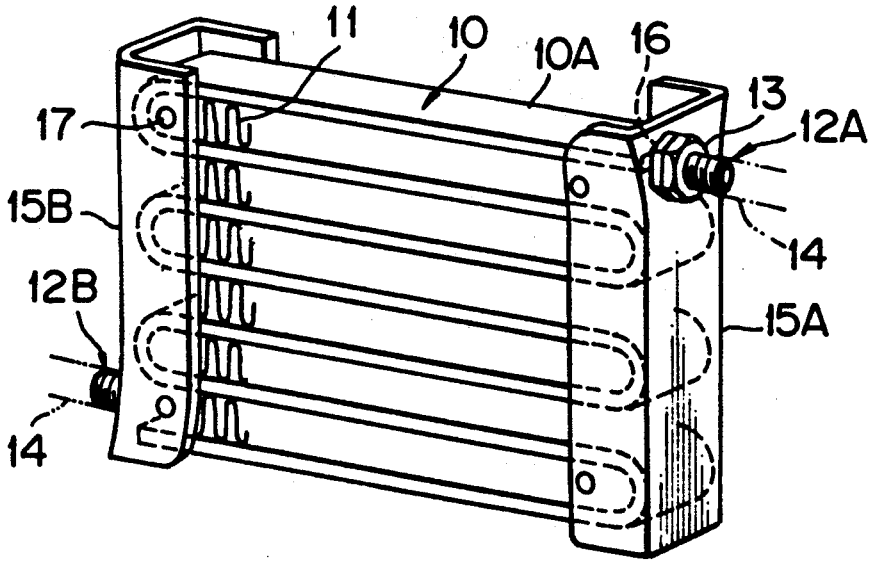
FIG. 2 PRIOR ART
FIG. 2 is a perspective view of another conventional heat exchanger.
Figure 3:
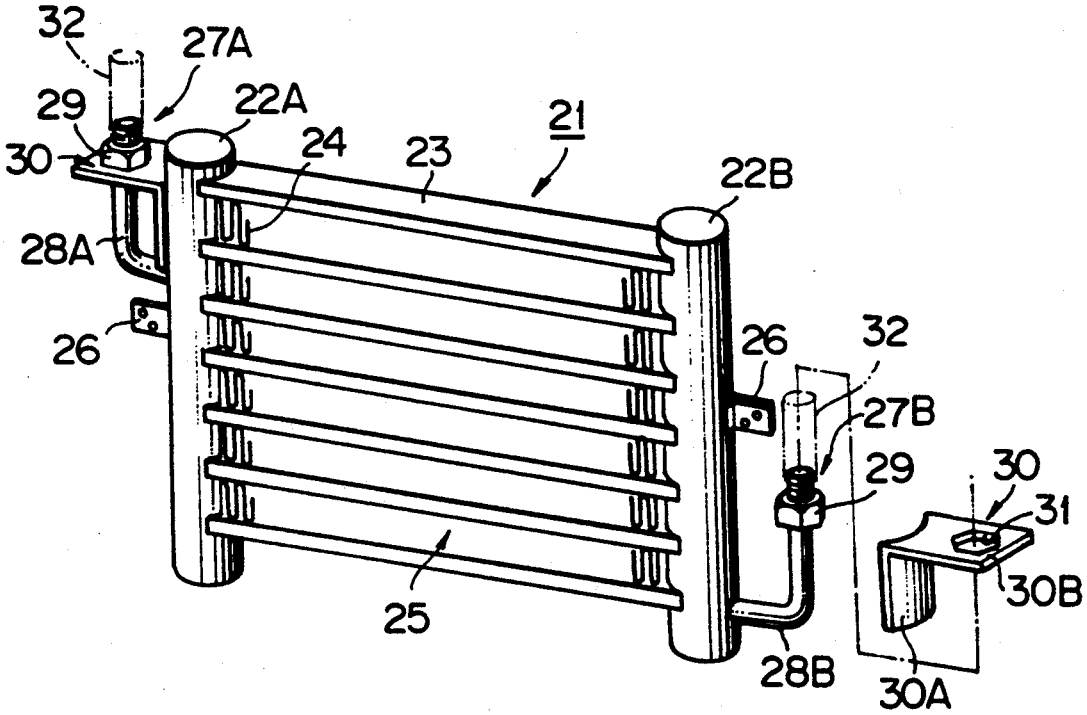
FIG. 3 is a perspective view of a heat exchanger according to a first embodiment of the present invention.
Figure 4:
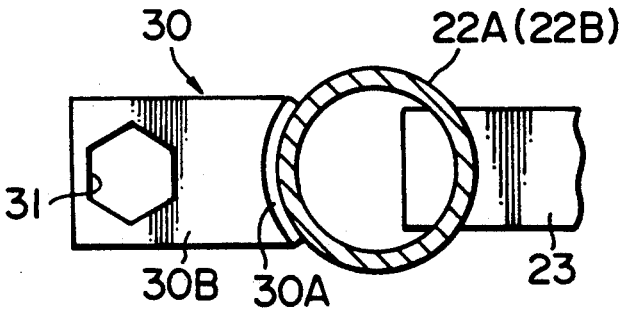
FIG. 4 is an enlarged cross sectional view of the portion of the supporting member of the heat exchanger shown in FIG. 3.

Referring to the drawings, wherein like numerals indicate like elements, FIGS. 3 and 4 illustrate a heat exchanger according to a first embodiment of the present invention. Heat exchanger 21 is constructed as a multi-flow type heat exchanger. Heat exchanger 21 has a pair of header pipes 22A and 22B extending in parallel relation to each other. A plurality of substantially parallel flat heat-transfer tubes 23 are disposed between header pipes 22A and 22B. Flat tubes 23 are connected in fluid communication with header pipes 22A and 22B. A plurality of corrugated fin units 24 are provided to alternate with flat tubes 23 such that each corrugated fin unit 24 is positioned between two flat tubes 23. The corrugated fin units are brazed to the flat tubes for permanent assembly. Header pipes 22A and 22B, flat heat-transfer tubes 23 and corrugated fin units 24 constitute heat exchanger body 25. Brackets 26 are separately fixed to each of header pipes 22A and 22B by welding. Heat exchanger 21 is attached to, for example, a frame of a vehicle (not shown) via brackets 26.

Inlet 27A constructed from inlet pipe 28A and tube fitting 29 is connected in fluid communication with header pipe 22A for introducing a heat exchange medium (for example, a refrigerant) into the header pipe. Outlet 27B constructed from outlet pipe 28B and tube fitting 29 is connected in fluid communication with header pipe 22B for discharging the heat exchange medium from header pipe 22B. Inlet 27A and outlet 27B are connected in fluid communication with external tubes 32 by tube fittings 29. Both of the tube fittings have longitudinal axes that are parallel to the longitudinal axes of header pipes 22A and 22B. Tube fitting 29 is a hexagonally shaped union joint. A supporting member 30 is fixed to each of header pipes 22A and 22B. Supporting member 30 has a connecting portion 30A fixed to the surface of the header pipe and a supporting portion 30B having a hexagonal hole 31 substantially corresponding to the hexagonal outer shape of tube fitting 29 to thus support the tube fitting when engaged in the hexagonal hole. Header pipes 22A and 22B, flat heat-transfer tubes 23 and corrugated fin units 24 are constructed from an aluminium material clad with a brazing material. The supporting member 30 is also constructed from the same or similar aluminium material clad with a brazing material.

Figure 5:
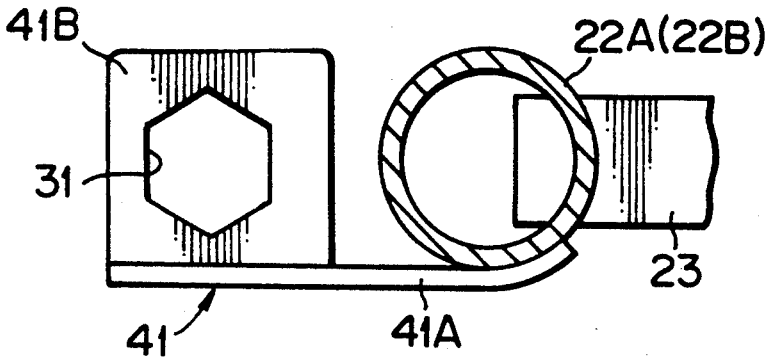
FIG. 5 is a cross sectional view of the portion of a supporting member according to a modification of the structure shown in FIG. 4.
Figure 6:
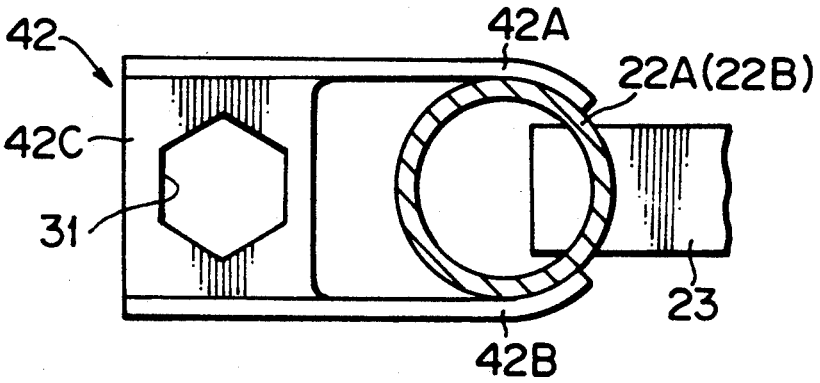
FIG. 6 is a cross sectional view of the portion of a supporting member according to another modification of the structure shown in FIG. 4.

The shape of supporting member 30 can be modified to various shapes. For example, as shown in FIG. 5, supporting member 41 may be constructed from a connecting portion 41A that is fixed to the surface of header pipe 22A (22B) on one side. A supporting portion 41B having a hexagonal hole 31 extends from the other end of connecting portion 41A. Alternatively, as shown in FIG. 6, supporting member 42 may be constructed from connecting portions 42A and 42B that are fixed to both sides of the surface of header pipe 22A (22B). A supporting portion 42C having hexagonal hole 31 extends from both connecting portions 42A and 42B.

In heat exchanger 21, FIG. 3, when tube fitting 29 is inserted into hexagonal hole 31 of supporting member 30 and connecting portion 30A of the supporting member is brought into contact with the surface of header pipe 22A (22B), supporting member 30 is brazed to header pipe 22A (22B). The brazing of header pipes 22A and 22B, flat heat-transfer tubes 23 and corrugated fin units 24 can be conducted simultaneously to make heat exchanger body 25. Therefore, the assembly and fabrication of the supporting member and heat exchanger body can be simplified.

Figure 7:
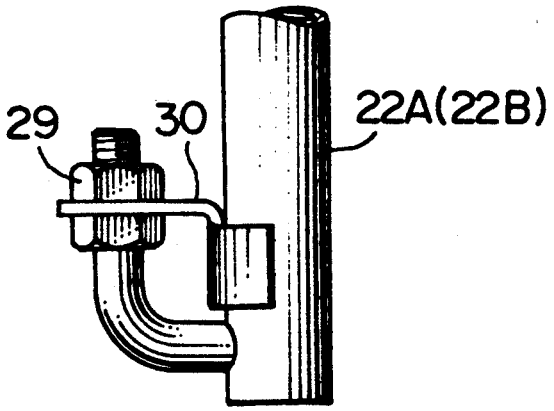
FIGS. 7 and 8 are partial side views of heat exchangers for explaining the advantage according to the present invention.
Figure 8:
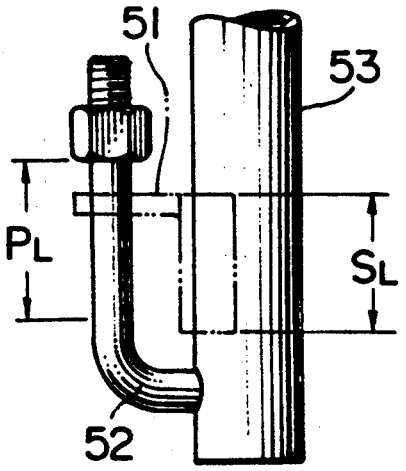
FIG. 8 PRIOR ART

Although it is considered that a supporting member 51 may support a inlet or outlet pipe 52 as shown in FIG. 8, the length $P_L$ of the pipe must be greater to some extent because the length $S_L$ for brazing the supporting member to the surface of a header pipe 53 must be considered. However, with the present invention, the length of the inlet or outlet pipe may be as short as that shown in FIG. 7, because tube fitting 29 is directly held by supporting member 30. Therefore, even in the case where there is insufficient room to use a long pipe, tube fitting 29 can be securely supported by supporting member 30.

Figure 9:
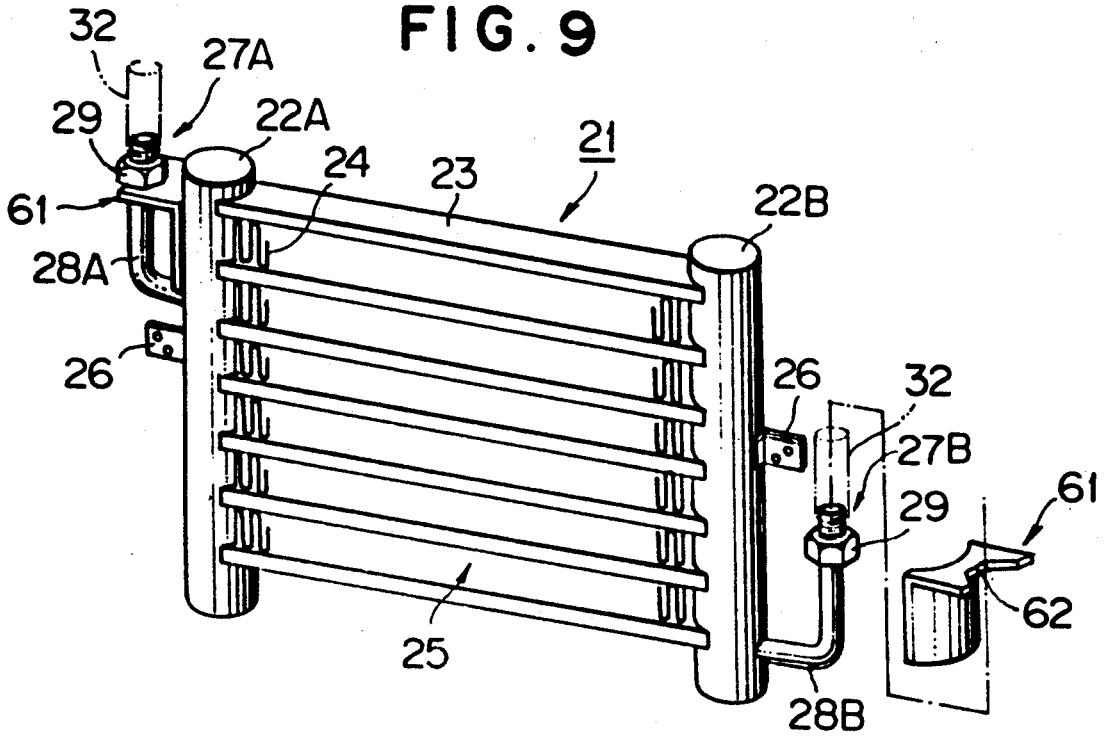
FIG. 9 is a perspective view of a heat exchanger according to another embodiment of the present invention.
Figure 10:
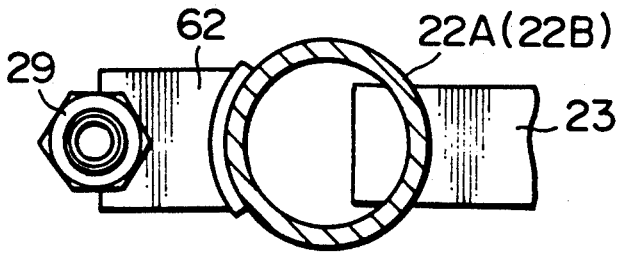
FIG. 10 is an enlarged cross sectional view of the portion of the supporting member of the heat exchanger shown in FIG. 9.

FIGS. 9 and 10 illustrate a heat exchanger according to another embodiment of the present invention. Heat exchanger body 25, brackets 26 and inlet 27A and outlet 27B have the same structures as those shown in FIG. 3. Supporting member 61 has an engaging portion 62 engaging tube fitting 29 from one side. Supporting members 61 are brazed to header pipes 22A and 22B with the engaging portions 62 engaging tube fittings 29.

Figure 11B:
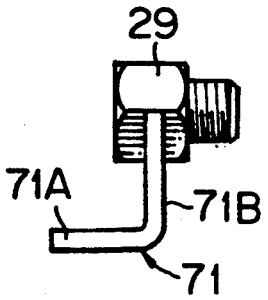
FIG. 11B is a partial side view of the structure shown in FIG. 11A.
Figure 11A:
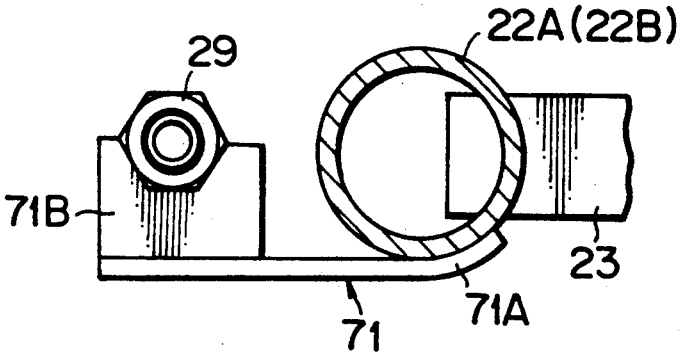
FIG. 11A is a cross sectional view of the portion of a supporting member according to a modification of the structure shown in FIG. 9.
Figure 12:
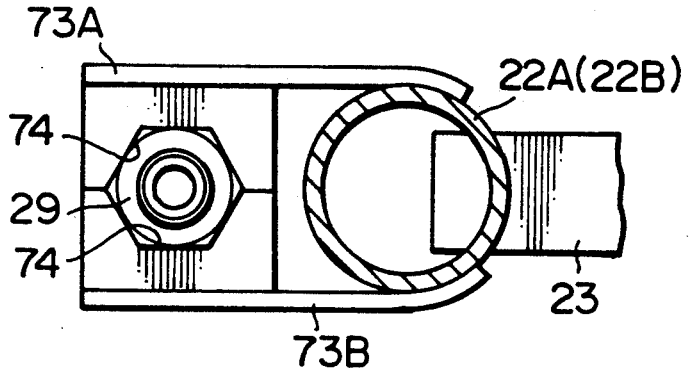
FIG. 12 is a cross sectional view of the portion of a supporting member according to another modification of the structure shown in FIG. 9.

Supporting member 61 can be modified to embody various shapes. For example, as shown in FIGS. 11A and 11B, supporting member 71 may be constructed from connecting portion 71A fixed at one end to the surface of header pipe 22A (22B). Extending from the other end of connecting portion 71A is supporting portion 71B having an engaging portion 72 for holding tube fitting 29 from one side. Alternatively, as shown in FIG. 12, two mirror image supporting members 73A and 73B each having a mirror image engaging portion 74 can be provided. Thus, supporting members are provided on both sides of tube fitting 29.

Figure 13:
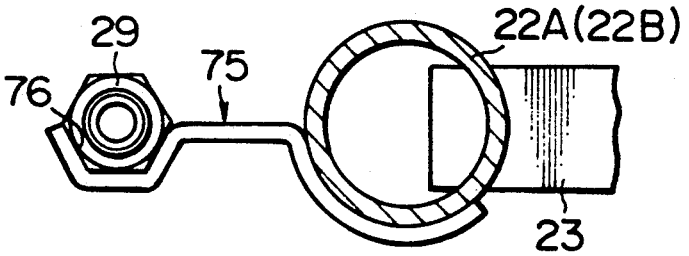
FIG. 13 is a cross sectional view of the portion of a supporting member according to a further modification of the structure shown in FIG. 9.
Figure 14B:
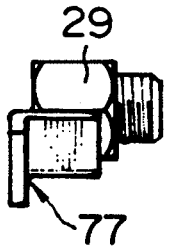
FIG. 14B is a partial side view of the structure shown in FIG. 14A.
Figure 14A:
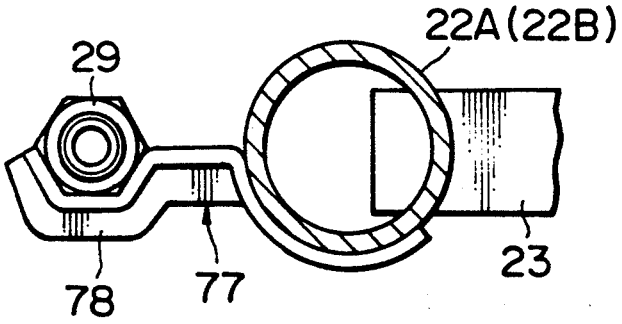
FIG. 14A is a cross sectional view of the portion of a supporting member according to a still further modification of the structure shown in FIG. 9.
Figure 15:
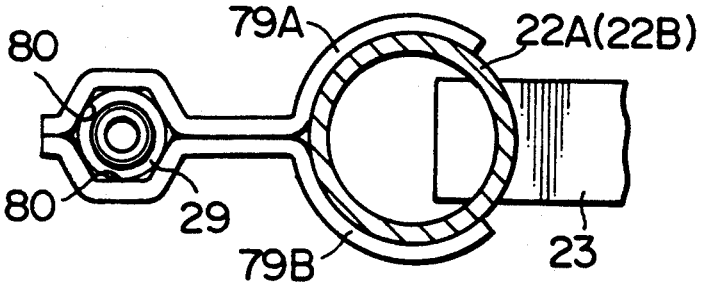
FIG. 15 is a cross sectional view of the portion of a supporting member according to a still further modification of the structure shown in FIG. 9.

FIGS. 13 to 15 illustrate other embodiments of the invention. In FIG. 13, supporting member 75 is press fit to engage tube fitting 29 via engaging portion 76. Supporting member 75 is brazed to header pipe 22A (22B) on the same side as engaging portion 76 engages tube fitting 29. In FIGS. 14A and 14B, supporting member 77 includes flange 78 for reinforcing the supporting member. In FIG. 15, two supporting members 79A and 79B, each having an engaging portion 80, are provided for holding tube fitting 29 from both sides.

Figure 16:
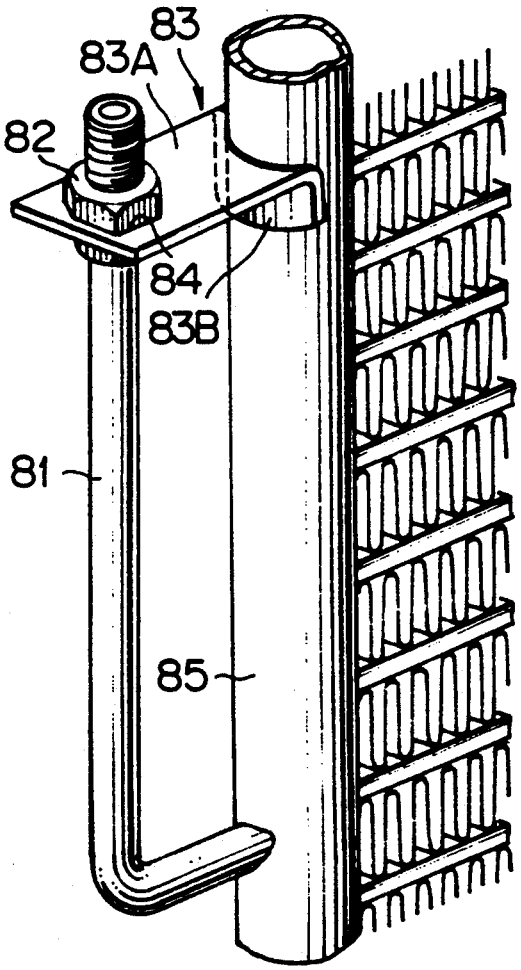
FIG. 16 is a partial perspective view of a heat exchanger according to another embodiment of the present invention.

FIG. 16 illustrates a heat exchanger according to another embodiment of the present invention. In this embodiment, inlet or outlet pipe 81 has a very long length. Tube fitting 82 is attached on the end of the long pipe 81. Supporting member 83 includes a hexagonally shaped hole 84 in supporting portion 83A for tube fitting 82. Attaching portion 83B of supporting member 83 is brazed to header pipe 85. Thus, even in the case of a long inlet or outlet pipe, tube fitting 82 can be easily and securely supported by supporting member 83.

Figure 17:
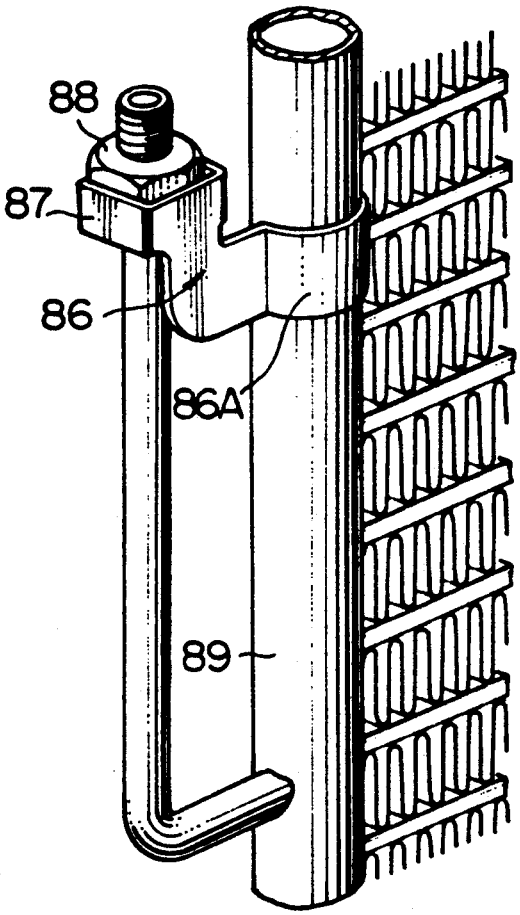
FIG. 17 is a partial perspective view of a heat exchanger according to another embodiment of the present invention.

FIG. 17 illustrates another embodiment of a heat exchanger according to the present invention. In this embodiment, supporting member 86 has an engaging portion 87 for holding both sides of tube fitting 88. Attaching portion 86A of supporting member 86 is brazed to header pipe 89. Supporting member 86 can securely engage tube fitting 88 with engaging portion 87. The structure of supporting member 86 is thus very simple.

Figure 18:
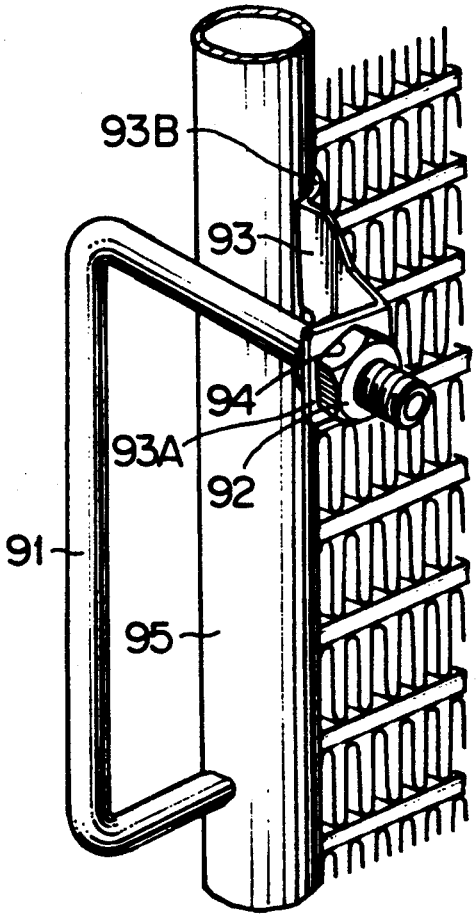
FIG. 18 is a partial perspective view of a heat exchanger according to another embodiment of the present invention.

FIG. 18 illustrates a heat exchanger according to another embodiment of the present invention. In this embodiment, inlet or outlet pipe 91 is formed as a bent pipe whose opening end is directed to the front or rear side of the heat exchanger. In other words, the longitudinal axis of the tube fitting is perpendicular to the longitudinal axis of the header pipe. Tube fitting 92 is attached on the open end of pipe 91. Supporting member 93 has a hexagonally shaped hole 94 on supporting portion 93A. Attaching portion 93B of supporting member 93 is brazed to header pipe 95. Thus, even in the case where the tube fitting is not parallel to the axis of the inlet or outlet pipe, the tube fitting can be easily and securely supported by the supporting member which has a corresponding shape.

Figure 19:
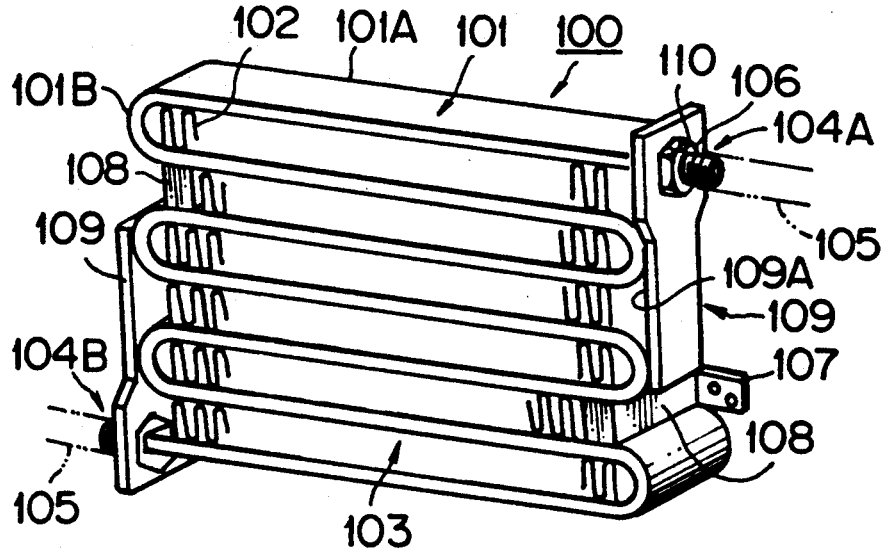
FIG. 19 is a perspective view of a heat exchanger according to another embodiment of the present invention.

FIG. 19 illustrates a serpentine type heat exchanger 100 according to another embodiment of the present invention. Straight portions 101A of serpentine flat tube 101 are disposed at a predetermined interval in parallel relation to each other. Corrugated fin units 102 are provided at each position between the parallel straight portions 101A. The corrugated fin units are brazed to the straight portions. Serpentine flat tube 101 and corrugated fin units 102 constitute heat exchanger body 103.

Inlet 104A is connected to one end of serpentine flat tube 101 for introducing a heat exchange medium into the heat exchanger body. Outlet 104B is connected to the other end of serpentine flat tube 101 for discharging the heat exchange medium from heat exchanger body 103. Inlet 104A and outlet 104B are connected to external tubes 105 by tube fittings 106. Small brackets 107 for attaching the heat exchanger to an external member (not shown) are provided at appropriate positions on the outer surface of heat exchanger body 103. In this embodiment, brackets 107 are attached on seat members 108 which are brazed to heat exchanger body 103, instead of corrugated fin units 102 or the curved portion of serpentine flat tube 101.

Tube fitting 106 is constructed of a union joint having a hexagonal outer shape. A supporting member 109 is fixed on each side of inlet 104A and outlet 104B. Supporting member 109 is brazed to curved outer end surface portion 101B of serpentine flat tube 101. In this embodiment, the connecting portion 109A of supporting member 109 is brazed to three curved outer end surface portions 101B of serpentine flat tube 101. Supporting member 109 has a hexagonally shaped hole 110 substantially corresponding to the hexagonal outer shape of tube fitting 106. Thus, when joined to heat exchanger body 103, supporting member 109 supports the tube fitting engaged in hexagonally shaped hole 110.

In the heat exchanger 100, tube fitting 106 is inserted into hexagonally shaped hole 110 of supporting member 109 and connecting surface 109A is brought into contact with the outer surface of serpentine flat tube 101. Supporting member 109 is thus brazed to the outer surface of serpentine flat tube 101, when corrugated fin units are brazed to serpentine flat tube 101 to make heat exchanger body 103 in one brazing step. Therefore, the assembly and fabrication of the heat exchanger body and supporting member are simplified.

Figure 20:
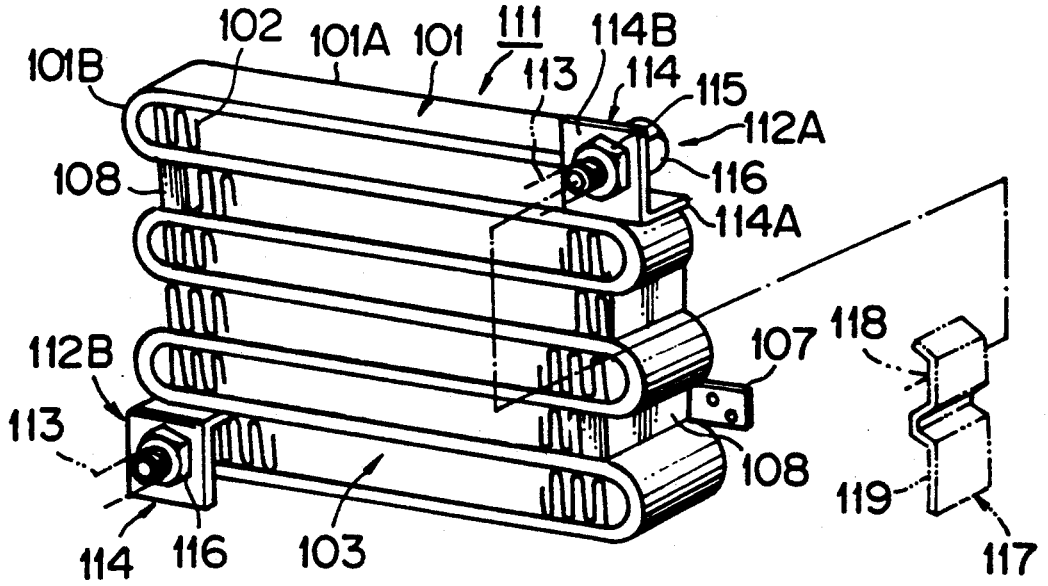
FIG. 20 is a perspective view of a heat exchanger according to another embodiment of the present invention.

FIG. 20 illustrates another serpentine type heat exchanger 111. Heat exchanger body 103 and attachment member 107 have the same structures as those shown in FIG. 19. In this embodiment, inlet 112A and outlet 112B are connected to front or rear side directed external tubes 113. Supporting members 114 are L-shaped. Each supporting member 114 has a connecting portion 114A brazed to the surface of serpentine flat tube 101 and a supporting portion 114B having a hexagonally shaped hole 115 for holding tube fitting 116. Another type of supporting member 117 is shown in dashed line. Supporting member 117 includes engaging portion 118 which engages tube fitting 116 and connecting portion 119 brazed to curved outer end surface portion 101B of serpentine flat tube 101. Supporting member 117 is brazed in a manner similar to that explained with reference to in FIG. 19.

Although several preferred embodiments of the present invention have been described in detail herein, it will be appreciated by those skilled in the art that various modifications can be made without materially departing from the novel and advantageous teachings of the invention. Accordingly, the embodiments disclosed herein are by way of example. The scope of the invention is defined by the claims annexed hereto and forming a part of this application.

I claim:

1. A heat exchanger including a heat exchanger body comprising:

a plurality of parallel heat transfer tube segments fluidly interconnected to define at least one flow path for a heat transfer medium;

a plurality of corrugated fin units selectively attached between said tube segments;

an inlet tube fitting and an outlet tube fitting, both of said fittings being attached to said heat exchanger body in fluid communication with said heat transfer tube segments for providing a path of ingress and egress for said heat transfer medium in said heat exchanger body; and support members secured to said heat exchanger body, each support member having an engaging surface which corresponds to the outer surface of at least one of said inlet and outlet tube fittings, said engaging surface of each of said support members contacting the outer surface of one of said inlet and outlet tube fittings and being secured thereto to hold said inlet and outlet tube fittings in fixed position relative to said heat exchanger body.

2. A heat exchanger as recited in claim 1 wherein said inlet and outlet tube fittings are union joints having a hexagonal outer shape in cross-section.

3. A heat exchanger as recited in claim 2 wherein at least one of said support members includes a supporting portion having a hexagonally shaped hole which corresponds to the hexagonal shape of said union joints.

4. A heat exchanger as recited in claim 3 wherein said support member also includes a connecting portion which is brazed to said heat exchanger body.

5. A heat exchanger as recited in claim 4 wherein said heat exchanger body includes two header pipes, one of said header pipes being attached in fluid communication with either end of said heat transfer tubes, said inlet tube fitting and said outlet tube fitting being attached in fluid communication with said header pipes.

6. A heat exchanger as recited in claim 5 wherein said support member has one connecting portion for securing said support member to said heat exchanger body.

7. A heat exchanger as recited in claim 5 wherein said support member has two connecting portions for securing said support member to said heat exchanger body.

8. A heat exchanger as recited in claim 5 wherein at least one of said union joints and one of said header pipes have parallel longitudinal axes.

9. A heat exchanger as recited in claim 5 wherein said union joints and said header pipes have perpendicular longitudinal axes.

10. A heat exchanger as recited in claim 2 wherein said support member includes an engaging surface which corresponds to at least two sides of said union joint.

11. A heat exchanger as recited in claim 10 wherein said support member comprises two mirror image parts.

12. A heat exchanger as recited in claim 10 wherein said heat transfer tubes are connected to form a serpentine type heat exchanger.

13. A heat exchanger as recited in claim 12 wherein said heat exchanger includes a support member that matingly engages the curved outer surface portions of said serpentine type heat exchanger.

14. A heat exchanger as recited in claim 10 wherein said heat exchanger body further includes two header pipes, one of said header pipes being attached in fluid communication with either end of said heat transfer tubes, said inlet tube fitting being attached in fluid communication with a first of said header pipes and said outlet tube fitting being attached in fluid communication with the second header pipe.

15. A heat exchanger as recited in claim 10 wherein said support members include reinforcing flanges positioned at lower edges of said support members for preventing twisting of said support members.

* * * * *